US008304156B2

(12) United States Patent
Akiyama et al.

(10) Patent No.: US 8,304,156 B2
(45) Date of Patent: Nov. 6, 2012

(54) MAGENTA ELECTROSTATIC DEVELOPING TONER, DEVELOPER FOR ELECTROSTATIC DEVELOPMENT, PRODUCTION METHOD OF ELECTROSTATIC DEVELOPING TONER, IMAGE FORMING METHOD AND IMAGE FORMING APPARATUS

(75) Inventors: Hitomi Akiyama, Kanagawa (JP); Junichi Tomonaga, Kanagawa (JP); Yasunobu Kashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 520 days.

(21) Appl. No.: 12/620,085

(22) Filed: Nov. 17, 2009

(65) Prior Publication Data

US 2010/0261114 A1 Oct. 14, 2010

(30) Foreign Application Priority Data

Apr. 13, 2009 (JP) ..... 2009-096886

(51) Int. Cl.
*G03G 9/09* (2006.01)

(52) U.S. Cl. ..... 430/108.1; 430/108.6; 430/108.23; 399/122; 399/320

(58) Field of Classification Search ..... 430/108.1, 430/108.6, 108.23; 399/122, 320
See application file for complete search history.

(56) References Cited

U.S. PATENT DOCUMENTS

| | | | | |
|---|---|---|---|---|
| 5,853,943 | A | 12/1998 | Cheng et al. | |
| 2006/0216628 | A1 * | 9/2006 | Nakamura et al. | 430/110.2 |
| 2007/0292779 | A1 | 12/2007 | Sato et al. | |

FOREIGN PATENT DOCUMENTS

| | | |
|---|---|---|
| JP | A-2006-171139 | 6/2006 |
| JP | A-2007-334139 | 12/2007 |
| JP | A-2009-42386 | 2/2009 |

* cited by examiner

*Primary Examiner* — Hoa V Le
(74) *Attorney, Agent, or Firm* — Oliff & Berridge, PLC

(57) ABSTRACT

A magenta electrostatic developing toner includes binder resin particles that do not contain a coloring agent or a release agent and has a shape factor SF1 of about 110 or less, the number of the binder resin particles being about 50 or less per 5,000 electrostatic developing toner particles; and inorganic particles that have a median diameter of about 5 nm to about 70 nm in an amount of about 0.01 mass % to about 0.4 mass % based on the mass of the electrostatic developing toner; and a magenta coloring agent that has an azo group.

11 Claims, 3 Drawing Sheets

MAGENTA ELECTROSTATIC DEVELOPING TONER, DEVELOPER FOR ELECTROSTATIC DEVELOPMENT, PRODUCTION METHOD OF ELECTROSTATIC DEVELOPING TONER, IMAGE FORMING METHOD AND IMAGE FORMING APPARATUS

CROSS-REFERENCE TO RELATED APPLICATIONS

This application is based on and claims priority under 35 USC 119 from Japanese Patent Application No. 2009-096886 filed on Apr. 13, 2009.

BACKGROUND

1. Technical Field

The present invention relates to a magenta electrostatic developing toner, a developer for electrostatic development, a production method of an electrostatic developing toner, an image forming method and an image forming apparatus.

2. Related Art

A method of visualizing image information through an electrostatic latent image, such as electrophotographic process, is being widely utilized at present in various fields. In the electrophotographic process, an electrostatic latent image formed on the surface of an electrophotographic photoreceptor (an electrostatic latent image holding member, hereinafter sometimes referred to as a "photoreceptor") through a charging step, an exposure step and the like is developed with an electrostatic developing toner (hereinafter sometimes simply referred to as a "toner"), and the electrostatic latent image is visualized through a transfer step, a fixing step and the like.

Many methods are known as the production method of a toner and as for the chemical production method, there are known, for example, a kneading-pulverization method of mixing a binder resin, a coloring agent and the like and subjecting the mixture to melting, pulverization and classification to obtain a toner, a suspension polymerization method of dispersing polymerizable monomers together with a coloring agent and the like in a liquid and polymerizing the monomers, and an emulsion polymerization-particle aggregation method of aggregating a resin particle with a coloring agent and the like and fusing aggregates.

The toner produced by a chemical production method is generally excellent in the structure controllability compared with the kneading-pulverization method and particularly, in the emulsion polymerization-particle aggregation method where an aggregated particle of size corresponding to the toner particle diameter is formed and then heated to fuse and coalesce aggregated particles and thereby obtain a toner, more precise control of the particle structure can be realized by performing free control from the internal layer to the surface layer in the toner.

SUMMARY

According to an aspect of the invention, there is provided a magenta electrostatic developing toner including binder resin particles that do not contain a coloring agent or a release agent and have a shape factor SF1 of about 110 or less, the number of the binder resin particles being about 50 or less per 5,000 electrostatic developing toner particles; and inorganic particles that have a median diameter of about 5 nm to about 70 nm in an amount of about 0.01 mass % to about 0.4 mass % based on the mass of the electrostatic developing toner; and a magenta coloring agent that has an azo group.

BRIEF DESCRIPTION OF THE DRAWINGS

Exemplary embodiment(s) of the present invention will be described in detail based on the following figures, wherein:

FIG. 3 is a schematic view showing one example of the construction of the image forming apparatus used for the image forming method of the present invention, wherein

Figure 1:
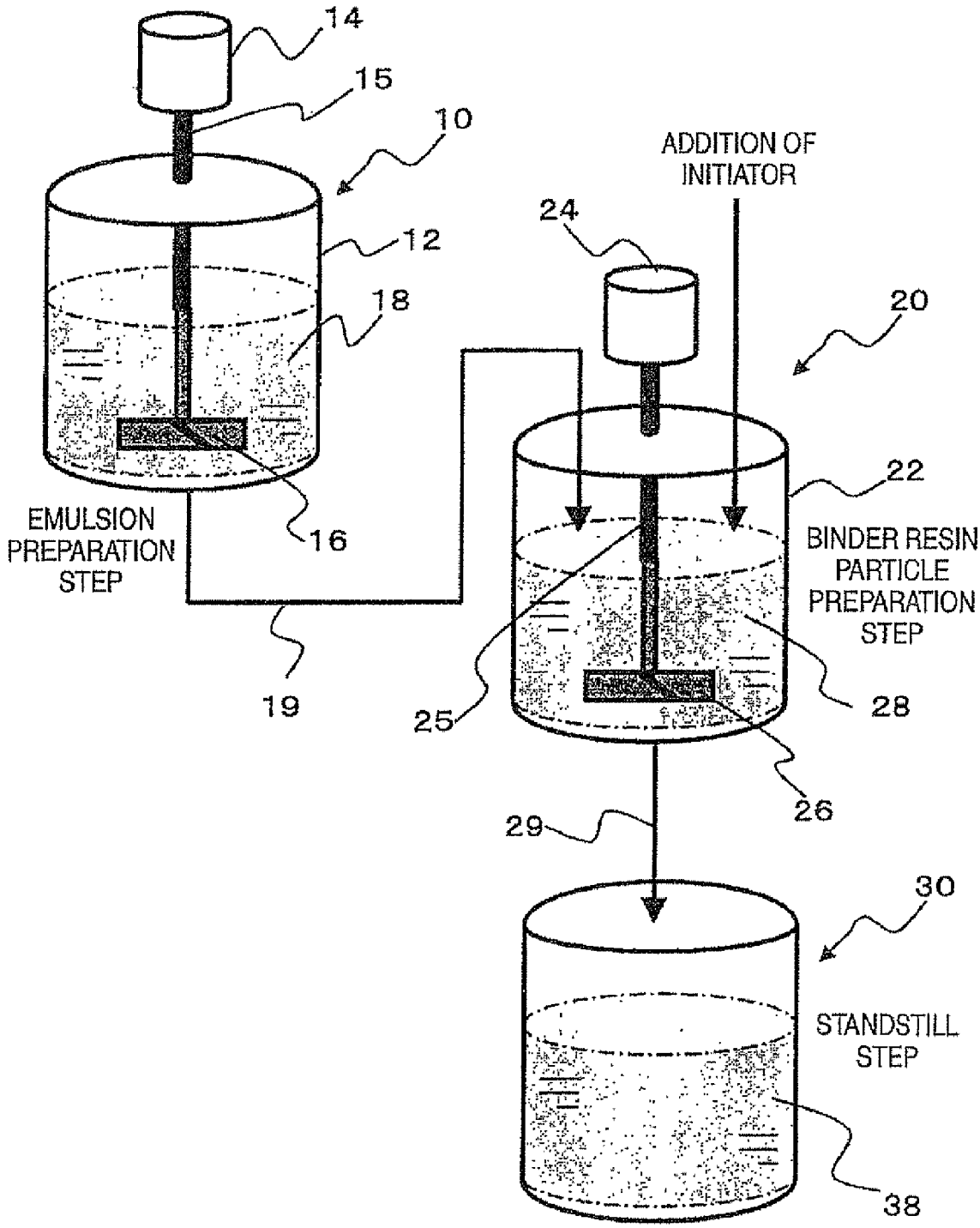
FIG. 1 is a schematic view showing the construction in one example of the production apparatus of a binder resin particle, which is used for the production method of a toner in an exemplary embodiment of the present invention.

10 denotes an emulsifying device, 12 denotes an emulsification tank, 14, 24, 54 and 84 denote driving sources, 15, 25, 55 and 85 denote stirring bars, 16, 26, 56, denote stirring members, 18 denotes a polymerizable monomer-containing emulsion, 19 and 29 denote pipes, 20 denotes a polymerizing device, 22 denotes a polymerization tank, 28 denotes a liquid emulsion polymer, 30 denotes a reservoir, 38 denotes a solution, 40 denotes a coloring agent reservoir, 41, 43, 45, 52, 62 and 72 denote valves, 42 denotes a inorganic particle reservoir, 44 denotes a aggregating agent reservoir, 50 denotes a coloring agent-inorganic particle aggregate and dispersion tank, 58 denotes a coloring agent-inorganic particle aggregate liquid dispersion, 60 denotes a binder resin particle liquid dispersion reservoir, 68 denotes a binder resin particle liquid dispersion, 70 denotes a release agent liquid dispersion reservoir, 78 denotes a release agent liquid dispersion, 80 denotes a toner particle preparation tank, 88 denotes a toner particle liquid dispersion, 200 denotes a image forming apparatus, 400 denotes a housing, 401*a* to 401*d* denote electrophotographic photoreceptors, 402*a* to 402*d* denote charging rolls, 403 denotes a exposure device, 404*a* to 404*d* denote developing devices, 405*a* to 405*d* denote toner cartridges, 406 denotes a drive roll, 407 denotes a tension roll, 408 denotes a backup roll, 409 denotes a intermediate transfer belt, 410*a* to 410*d* denote primary transfer rolls, 411 denotes a tray (transfer-receiving medium tray), 412 denotes a conveying roll, 413 denotes a secondary transfer roll, 414 denotes a fixing roll, 415*a* to 415*d* and 416 denote cleaning blades, and 500 denotes a transfer-receiving medium.

DETAILED DESCRIPTION

The magenta electrostatic developing toner, the developer for electrostatic development, the production method of an electrostatic developing toner, the image forming method and the image forming apparatus according to an exemplary embodiment of the present invention are described below.

[Electrostatic Developing Toner and Production Method Thereof]

The magenta electrostatic developing toner (hereinafter, sometimes referred to as a "magenta toner") is a magenta, electrostatic developing toner where the number of binder resin particles not containing a coloring agent and a release agent and having a shape factor SF1 of 110 or less, or about 110 or less, contained in the magenta electrostatic developing toner, is 50 or less, or about 50 or less per 5,000 electrostatic developing toner particles, an inorganic particle having a median diameter of 5 nm to 70 nm or about 5 μm to about 70 nm is contained in an amount of 0.01 mass % to 0.4 mass % or about 0.01 mass % to about 0.4 mass based on the mass of the magenta electrostatic developing toner, and a magenta coloring agent having an azo group is contained as a coloring agent.

A method of adding an inorganic particle to the inside of a toner particle is known as a technique for controlling the toner viscosity to a certain degree. The particle is considered to function as a filler by virtue of being present between resin chains of the binder resin constituting the toner and control the aggregation between resin molecules. If the amount of the inorganic particle added is large, the viscosity change may be excessively large and the control of fixability may conversely become difficult. Usually, the material on which the toner is fixed is paper and since unevenness is produced in the paper due to fibers, the quantity of heat applied to the toner differs between when the toner particle is present in a recess and when present on a protrusion. This occurs because the paper needs to be also heated at the same time for heating and melting the toner and the paper is more difficult to be heated in the protruded portion of the paper. As a result, the toner in the protruded portion of the paper is less heated than the toner in the recessed portion, and a difference in the gloss is readily generated. In addition, when a resin particle of size corresponding to the toner diameter is present, the resin particle does not contain a release agent and therefore, is liable to be offset at the fixing. Offset is more readily caused particularly in the halftone portion where the number of toner particles is small and in turn, the amount of the release agent supplied from the toner particle is small, and moreover, the amount of the release agent bled out is smaller in the protruded portion of the paper, where the heating temperature of the toner is low, as a result, in the halftone portion, the protruded portion of the paper is more liable to involve offset of the toner particle along with offset of the resin particle.

In the present invention, the toner contains in the inside thereof an inorganic particle in an amount of 0.01 wt % to 0.4 wt %, or about 0.01 wt % to about 0.4 wt % based on the total toner amount and at the same time, contains a magenta coloring agent having an azo group, so that the inorganic particle can be easily added to the inside of the toner due to polarity of the azo group moiety. As a result, the generation of viscosity difference due to heating of the toner can be suppressed to a certain degree and additionally, the number of resin particles is limited to 50 or less, or about 50 or less per 5,000 toner particles, whereby a toner free from a problem such as generation of offset may be obtained.

The magenta coloring agent includes a β-naphthol-type pigment such as C.I. Pigment Red 146 typified by the following formula (1) and C.I. Pigment Red 2, 5, 7, 8, 9, 10, 11, 12, 13, 14, 15, 16, 17, 18, 21, 22, 23, 31, 32, 95, 112, 114, 119, 136, 147, 148, 150, 164, 170, 184, 187, 188, 210, 212, 213, 222, 223, 238, 245, 253, 256, 258, 261, 266, 267, 268 and 269; an azo lake-type pigment such as C.I. Pigment Red 57:1 typified by the following formula (2) and C.I. Pigment Red 18:1, 48:2, 48:3, 48:4, 48:5, 50:1, 51, 52:1, 52:2, 53:1, 53:2, 53:3, 58:2, 58:4, 64:1, 68 and 200; a disazo-type pigment such as C.I. Pigment Red 37, 38, 41 and 111 and C.I. Pigment Orange 13, 15, 16, 34 and 44; and a disazo condensation-type pigment such as C.I. Pigment Red 144, 166, 214, 220, 221, 242, 248 and 262 and C.I. Pigment Orange 31.

(1)

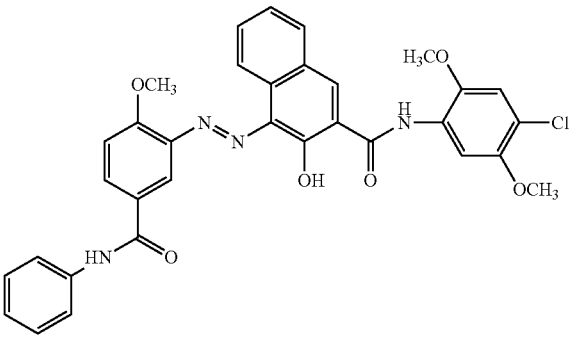

(2)

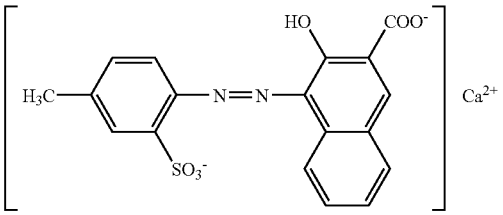

Examples of the inorganic particle having a median diameter of 5 nm to 70 nm include all inorganic particles usually used as an external additive to the toner surface, such as silica, alumina and titania.

If the content of the internally added inorganic particle is less than 0.01 mass % or exceeds 0.4 masse, based on the mass of the toner, the number of binder resin particles not containing the above-described magenta coloring agent having an azo group and a release agent, in 5,000 toner particles, exceeds 50 and when an image is formed by the later-described image forming apparatus, color reproduction of a halftone image may be impaired.

Also, if the number of truly spherical resin particles not containing a coloring agent and a release agent and having a shape factor SF1 of 110 or less (hereinafter, referred to as a "colorless binder resin particle") exceeds 50 per 5,000 electrostatic developing toner particles, since the colorless binder resin particle mixed in the toner has less contact with a carrier in the developing machine due to its truly spherical shape and is liable to be kept in the lowly charged state, the resin particle can be hardly developed and remains in the developing device. With an increase in the amount of the colorless binder resin particle in the developing device, the toner charge distribution in the developing device is changed and eventually, the toner is developed in the form of containing the colorless binder resin particle in a large amount compared with a normal toner composition, as a result, for example, in the case of outputting a halftone image, an image defect such as color missing may be markedly generated and color reproduction may deteriorate. In an exemplary embodiment of the present invention, the number of binder resin particles not containing a coloring agent and a release agent and having a shape factor SF1 of 110 or less is preferably 30 or less per 5,000 electrostatic developing toner particles.

Various materials constituting the toner in an exemplary embodiment of the present invention, other than those described above, are described below.

Examples of the binder resin used include homopolymers or copolymers of styrenes such as styrene and chlorostyrene; monoolefins such as ethylene, propylene, butylene and isoprene; vinyl esters such as vinyl acetate, vinyl propionate, vinyl benzoate and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; or vinyl ketones such as vinyl methyl ketone, vinyl hexyl ketone and vinyl isopropenyl ketone. Examples of the particularly typical binder resin include a polystyrene, a styrene-alkyl acrylate copolymer, a styrene-alkyl methacrylate copolymer, a styrene-acrylonitrile copolymer, styrene-butadiene copolymer, styrene-maleic anhydride copolymer, a polyethylene and a polypropylene. Other examples include a polyester, a polyurethane, an epoxy resin, a silicone resin, a polyamide, a modified rosin and paraffin wax.

Examples of the release agent for use in the toner of an exemplary embodiment of the present invention include low molecular weight polyolefins such as polyethylene, polypropylene and polybutene; silicones exhibiting a softening temperature when heated; fatty acid amides such as oleic acid amide, erucic acid amide, ricinoleic acid amide and stearic acid amide; vegetable waxes such as carnauba wax, rice wax, candelilla wax, Japan wax and jojoba oil; animal waxes such as bees wax; mineral/petroleum waxes such as montan wax, ozokerite, ceresin, paraffin wax, microcrystalline wax and Fischer-Tropsch wax; ester-based waxes such as aliphatic ester, montanic acid ester and carboxylic acid ester; and modified products thereof. One of these release agents may be used alone, or two or more thereof may be used in combination. The release agent for use in the toner of an exemplary embodiment of the present invention is preferably a release agent having low compatibility with the binder resin, for example, a release agent with low polarity, such as polyethylene, paraffin and polyolefin, and bleeding out of the release agent at the fixing is advantageous in terms of releasability. Also, in view of good release of the toner from the paper or less occurrence of a reproduction failure in the case of outputting a halftone image, the weight average molecular weight of the release agent is preferably from 500 to 5,000 or from about 500 to about 5,000 and the melting temperature is preferably from 60° C. to 100° C. or from about 60° C. to about 100° C. As described above, the release agent needs to enter between a fixing member and an image by leaving from the inside of the toner in a short time and therefore, a release agent of the type exemplified above, which is a release agent having the above-described weight average molecular weight and melting temperature, is preferred.

Other than those described above, various components such as internal additive, charge controlling agent and organic particle may be added, if desired. Examples of the internal additive include a magnetic material such as a metal (e.g., ferrite, magnetite, reduced iron, cobalt, nickel, manganese), an alloy thereof and a compound containing such a metal. Examples of the charge controlling agent include a quaternary ammonium salt compound, a nigrosine-based compound, a dye composed of an aluminum, iron or chromium complex, and a triphenylmethane-based pigment.

As for the aggregating agent, an inorganic salt or a divalent or greater valet metal salt may be suitably used, other than a surfactant. In particular, use of a metal salt is preferred in view of aggregation control and properties such as toner chargeability. This is described in detail later in connection with the production method of a toner.

The volume average particle diameter of the toner in an exemplary embodiment of the present invention is from 3 μm to 10 μm or from about 3 μm to about 10 μm, preferably from 3 μm to 9 μm or from about 3 μm to about 9 μm, more preferably from 3 μm to 8 μm or from about 3 μm to about 8 μm. Also, the number average particle diameter of the toner in an exemplary embodiment of the present invention is preferably from 3 μm to 10 μm, more preferably from 2 μm to 8 μm. If the particle diameter is too small, not only the production is unstable but also the chargeability is insufficient, giving rise to reduction in the developability, whereas if it is excessively large, the resolution of an image deteriorates.

The production method of a toner in an exemplary embodiment of the present invention has a step of previously adding an aggregating agent to an azo group-containing magenta coloring agent and an inorganic particle to prepare a liquid dispersion having aggregated and dispersed therein a coloring agent and an inorganic particle, an aggregation step of mixing the liquid dispersion having aggregated and dispersed therein an azo group-containing magenta coloring agent and an inorganic particle, a binder resin particle liquid dispersion having dispersed therein a binder resin particle, and a release agent liquid dispersion having dispersed therein a release agent, thereby causing aggregation into a particle containing a release agent, a binder resin particle, a coloring agent and an inorganic particle, and a fusing step of fusing the obtained aggregates by heating at a temperature not lower than the glass transition temperature of the binder resin particle, thereby forming a toner particle.

The above-described magenta coloring agent is difficult to disperse compared with other carbon black or cyan pigments. Therefore, in an exemplary embodiment of the present invention, an aggregating agent is previously added to an azo group-containing magenta coloring agent and an inorganic particle to prepare a liquid dispersion having aggregated and dispersed therein a coloring agent and an inorganic particle, and the inorganic particle having the above-described median diameter is allowed to be present on the particle surface of the azo group-containing magenta coloring agent, whereby the magenta coloring agent is prevented from locally aggregating in the liquid dispersion containing the coloring agent and it is made easy to control the viscosity produced due to a dispersion failure of the coloring agent in the toner.

One example of the production method of a toner by an emulsion polymerization-aggregation method in an exemplary embodiment of the present invention is described below by referring to FIGS. 1 and 2.

FIG. 1 shows one example of the construction of an emulsion polymerization apparatus used in the production method of a toner in an exemplary embodiment of the present invention. The emulsion polymerization apparatus is an apparatus for producing a binder resin particle that is used at the production of a toner, and has an emulsifying device 10 for emulsifying one or more kinds of polymerizable monomers, water and, if desired, a surfactant, a polymerizing device 20 for adding an initiator to the polymerizable monomer-containing emulsion prepared in an emulsification tank 12 and performing emulsion polymerization to prepare a binder resin particle, and, if desired, a reservoir 30 for reserving the binder resin particle-containing solution prepared in a polymerization tank 22 and allowing the solution to stand still.

The emulsifying device 10 is provided with an emulsification tank 12, a stirring bar 15 having a stirring member 16 for stirring the emulsion 18 in the emulsification tank 12, and a driving source 14 for driving in rotation the stirring bar 15. Also, the polymerizing device 20 is provided with a polymerization tank 22 into which the emulsion extracted from the bottom of the emulsification tank 12 of the emulsifying device 10 is introduced through a pipe 19, a stirring bar 25 having a stirring member 26 for stirring the liquid emulsion polymer 28 in the polymerization tank 22, and a driving source 24 for driving in rotation the stirring bar 25. In the reservoir 30, the binder resin particle-containing solution prepared in the polymerization tank 22 is introduced through a pipe 29 and separated by specific gravity into a colorless binder resin particle containing neither coloring agent nor a release agent and having a size analogous to that of the toner and a binder resin particle having a particle diameter of, for example, 1 μm or less.

In an exemplary embodiment of the present invention, a binder resin particle is formed using any or all of the following steps (I) to (III).

As the step of (I), in the emulsifying device 10, an oil phase containing a polymerizable monomer for preparing a binder resin and an aqueous phase are emulsified with high-speed stirring to produce a polymerizable monomer-containing emulsion 18. The term "high-speed stirring" as used herein means a speed of 1.2 times or more the stirring speed in a normal emulsification step, for example, 1,000 rpm. Furthermore, in the emulsifying device 10, at the time of high-speed stirring, the emulsification tank 12 is once cooled in the range from −3° C. to −20° C. based on the normal emulsion preparation temperature (for example, 30° C.). Thanks to this cooling, as described above, imbalance of the polymerizable monomer in a solubilizing micelle can be suppressed and compared with the case of not cooling the tank, production of a colorless binder resin particle not containing a coloring agent and a release agent and having a size analogous to that of the toner can be reduced.

As the step of (II), in the polymerizing device 20, high-speed stirring is performed when adding a polymerization initiator to the polymerizable monomer-containing emulsion 18 added in the aqueous phase so as to polymerize the polymerizable monomer and thereby prepare a binder resin particle. The term "high-speed stirring" as used herein means a speed of 1.5 times or more the stirring speed in a normal emulsification step, for example, from 160 rpm to 240 rpm. Subsequently, in the step of accelerating the polymerization, the stirring speed is decreased, whereby the shape of the colorless binder resin particle can be controlled. More specifically, the shape factor SF1 can be controlled to 120 or less by decreasing the stirring speed of 1.5 time or more to from 0.9 times to 1.1 times.

As the step of (III), in the reservoir 30, the binder resin particle-containing solution 38 prepared in the polymerization tank 22 is left standing still and by utilizing the difference in the precipitation speed according to the particle diameter, the coarse binder resin particle of toner particle size is precipitated in the reservoir 30 and separated from the binder resin particle having a particle diameter of, for example, 1 μm or less. Then, the solution containing a binder resin particle having a particle diameter of, for example, 1 μm or less on the supernatant side of the solution in the reservoir 30 after standing still is collected and used in the later-stage toner production step. The time for which the solution is left standing still differs according to the kind of the binder resin and the addition of a specific gravity controlling agent and is therefore appropriately selected, but in the case of a tank having a depth of 25 cm, the time only as a guide is, for example, from 15 hours to 48 hours.

Alternatively, in the reservoir 30, the binder resin particle-containing solution 38 prepared in the polymerization tank 22 is once separated by a centrifugal separator (not shown) into a binder resin particle having a particle diameter of, for example, 1 μm or less and a binder resin particle larger than that. Also in this case, the supernatant after centrifugal separation, for example, a solution containing a binder resin particle having a particle diameter of 1 μm or less, is collected, and the supernatant solution containing a binder resin particle having a particle diameter of 1 μm or less is used for the binder, resin particle liquid dispersion in later stage. The centrifugal effect differs according to the kind of the binder resin or the particle size distribution of the resin particle and therefore, is appropriately selected, but the solution is separated by adding a centrifugal effect of 500 G to 1,000 G.

In the foregoing pages, the method for producing a binder resin particle by emulsion polymerization is described as an example, but the production method is not limited thereto, and the binder resin particle may be produced similarly by a suspension polymerization method.

Figure 2:
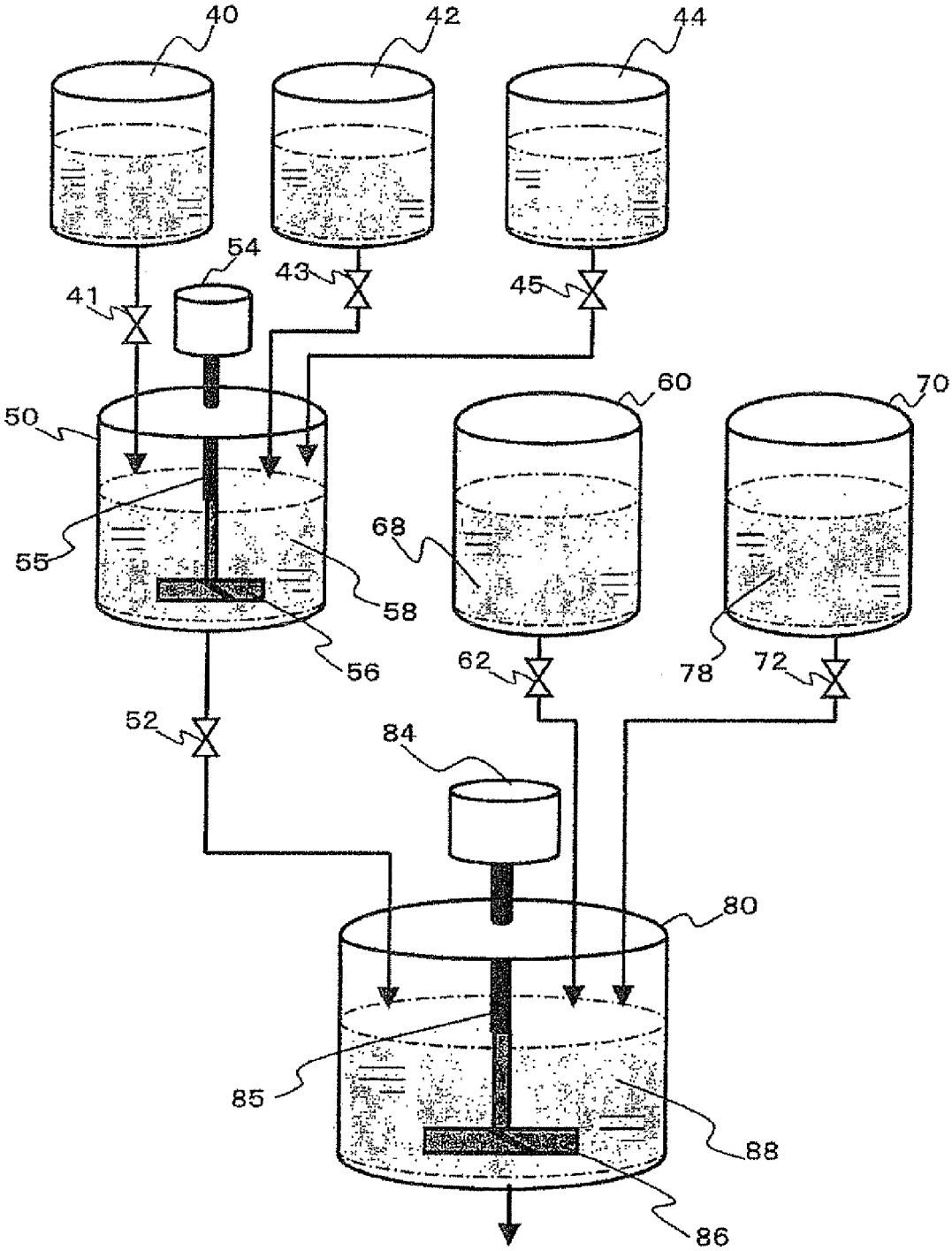
FIG. 2 is a schematic view showing the construction in one example of the production apparatus of a toner particle using respective liquid dispersions in an exemplary embodiment of the present invention.

Accordingly, in the case of preparing a coloring agent-inorganic particle aggregate liquid dispersion 58, as shown in FIG. 2, first, valves 41 and 43 are opened while keeping a valve 45 closed, and a coloring agent solution and an inorganic particle solution each in a predetermined amount are fed to a coloring agent-inorganic particle aggregation and dispersion tank 50 from a coloring agent reservoir 40 and an inorganic particle reservoir 42. After the elapse of a predetermined time, the valves 41 and 43 are closed, the valve 45 is opened, and a predetermined amount of an aggregating agent solution is fed to the coloring agent-inorganic particle aggregation and dispersion tank 50 from an aggregating agent reservoir 44 and stirred to prepare a coloring agent-inorganic particle aggregate liquid dispersion 58. The term "high-speed stirring" as used herein means a speed of 1.2 times or 1.5 times or more the stirring speed in the preparation step of a normal coloring agent liquid dispersion, for example, the stirring speed when preparing the coloring agent-inorganic particle aggregate liquid dispersion 58. Also, the "predetermined amount of an aggregating agent solution" indicates an amount when the pH of the coloring agent-inorganic particle aggregate liquid dispersion 58 becomes from 8 to 10, and the "after the elapse of a predetermined time" is appropriately selected according to the dispersed state of the coloring agent and the inorganic particle. Here, the coloring agent-inorganic particle aggregation and dispersion tank 50 is provided with a stirring bar 55 having a stirring member 56 and a driving source 54 for driving in rotation the stirring bar 55.

The apparatus for use in the method of producing a toner by an aggregation method using respective liquid dispersions in an exemplary embodiment of the present invention has a binder resin particle liquid dispersion reservoir 60 for reserving a binder resin particle liquid dispersion 68 containing a binder resin particle having a particle diameter of, for example, 1 μm or less, which is separated in the reservoir 30 of FIG. 1, a release agent liquid dispersion reservoir 70 for reserving a release agent liquid dispersion 78 containing a release agent, and a toner particle preparation tank 80. The toner particle preparation tank 80 is provided with a stirring bar 85 having a stirring member 86 for stirring the solution in the tank, and a driving source 84 for driving in rotation the stirring bar 85. Also, the toner particle preparation tank 80 is connected to the coloring agent-inorganic particle aggregation and dispersion tank 50, the binder resin particle liquid dispersion reservoir 60 and the release agent liquid dispersion reservoir 70 through liquid feed paths having valves 52, 62 and 72, respectively. Furthermore, a heating unit (for example, a jacket) not shown is provided in the outer periphery of the toner particle preparation tank 80.

Accordingly, in the case of preparing a toner particle, valves 52, 62 and 72 are opened, and a coloring agent-inorganic particle aggregate liquid dispersion 58, a binder resin particle liquid dispersion 68 and a release agent liquid dispersion 78 are fed to the toner particle preparation tank 80 from the coloring agent-inorganic particle aggregation and dispersion tank 50, the binder resin particle liquid dispersion reservoir 60 and the release agent liquid dispersion reservoir tank 70, respectively. After mixing respective liquid dispersions with stirring by the stirring member 86, a solution containing, for example, an acidic aggregating agent (not shown) is added such that the pH of the mixed solution becomes weakly acidic (for example, a pH of 4 to 5), and a release agent, a binder resin particle, a coloring agent and an inorganic particle are aggregated to form an aggregated particle having a toner particle diameter. The obtained aggregates are fused by heating at a temperature not lower than the glass transition temperature of the binder resin particle to form a toner particle liquid dispersion 88 containing toner particles, which is then appropriately subjected to filtration and drying to produce an electrostatic developing toner. Examples of the acidic aggregating agent added to the toner particle preparation tank 80 include acids such as hydrochloric acid, sulfuric acid, nitric acid, acetic acid and oxalic acid, and metal salts of inorganic acids, such as polyaluminum chloride, magnesium chloride, sodium chloride, aluminum sulfate, calcium sulfate, ammonium sulfate, aluminum nitrate, silver nitrate and copper nitrate.

[Developer for Electrostatic Development]

The toner obtained by the above-described production method of an electrostatic developing toner of the present invention is used for an electrostatic developer. The developer is not particularly limited except for containing the electrostatic developing toner and may have an appropriate component composition according to the purpose.

The electrostatic developing toner is prepared as a one-component electrostatic developer when used alone and is prepared as a two-component electrostatic developer when used in combination with a carrier.

The carrier is not particularly limited and includes a carrier which itself is known, and known carriers such as a resin-coated carrier can be used.

Specific examples of the carrier include the following resin-coated carriers. That is, examples of the core particle of the carrier include a normal iron powder, ferrite or magnetite shaped product. The average particle diameter thereof is approximately from 30 μm to 200 μm. Examples of the coat resin of the core particle include styrenes such as styrene, para-chlorostyrene and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acryls such as dimethylaminoethyl methacrylate; vinyl nitriles such as acrylonitrile and methacrylonitrile; vinyl pyridines such as 2-vinylpyridine and 4-vinylpyridine; vinyl ethers such as vinyl methyl ether and vinyl isobutyl ether; vinyl ketones such as vinyl methyl ketone, vinyl ethyl ketone and vinyl isopropenyl ketone; olefins such as ethylene and propylene; silicones such as methyl silicone and methylphenyl silicone; a copolymer of vinyl-based fluorine-containing monomers such as vinylidene fluoride, tetrafluoroethylene and hexafluoroethylene; polyesters containing bisphenol, glycol or the like; an epoxy resin; a polyurethane resin; a polyamide resin; a cellulose resin; and a polyether resin. One of these resins may be used alone, or two or more thereof may be used in combination. The amount of the coat resin is approximately from 0.1 parts by mass to 10 parts by mass, preferably front 0.5 parts by mass to 3.0 parts by mass, based on the carrier. In the production of the carrier, a heating-type kneader, a heating-type Henschel mixer, a UM mixer or the like can be used. Depending on the amount of the coat resin, a heating-type fluid rolling bed, a heating-type kiln or the like can be used.

In the electrostatic developer, the mixing ratio between the electrostatic developing toner and the carrier is not particularly limited and may be selected according to the purpose.

[Image Forming Apparatus]

The image forming apparatus in an exemplary embodiment of the present invention is described below.

Figure 3:
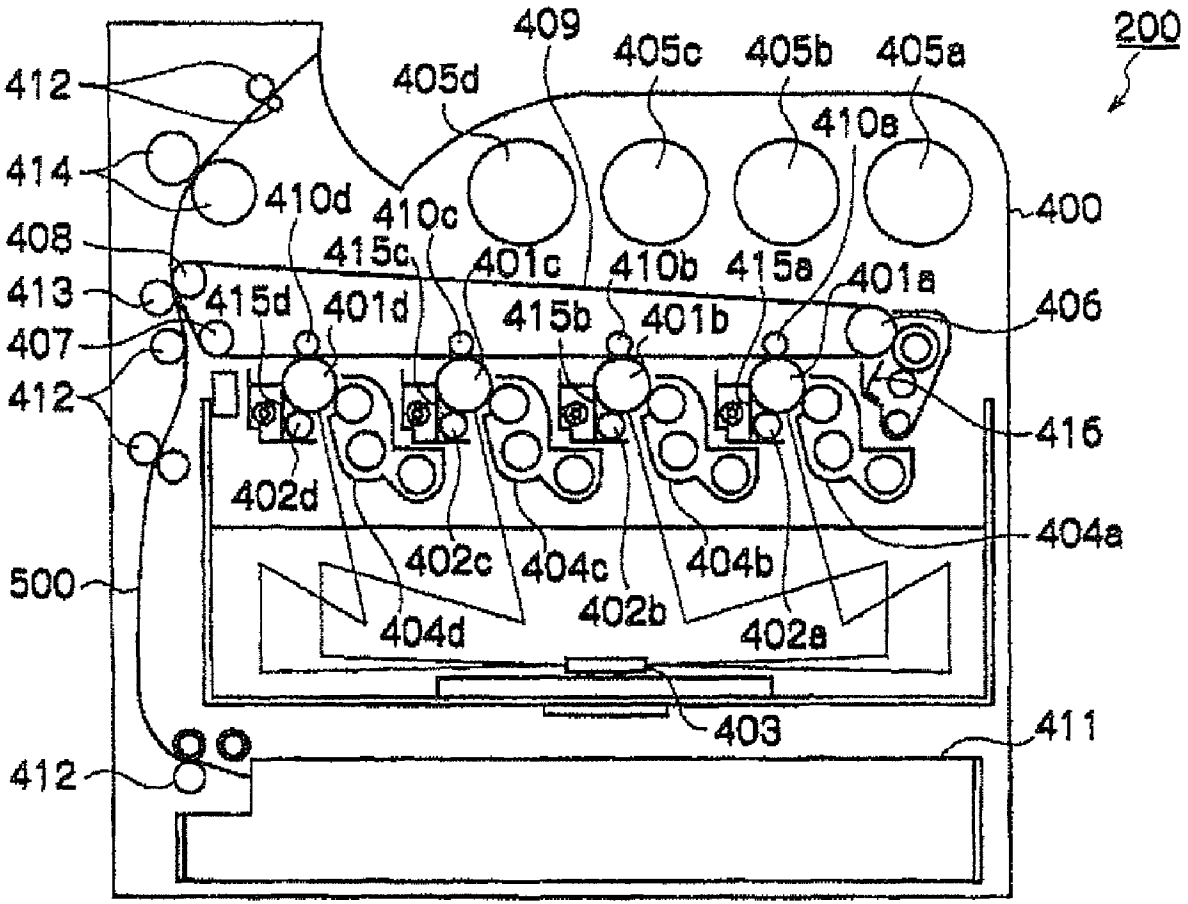

FIG. 3 is a schematic view showing a construction example of the image forming apparatus for forming an image by the image forming method of an exemplary embodiment of the present invention. In the image forming apparatus 200 shown, four electrophotographic photoreceptors 401*a* to 401*d* are juxtaposed to each other along an intermediate transfer belt 409 inside of a housing 400. As regards four electrophotographic photoreceptors 401*a* to 401*d*, for example, the electrophotographic photoreceptor 401*a*, electrophotographic photoreceptor 401*b*, electrophotographic photoreceptor 401*c* and electrophotographic photoreceptor 401*d* can form images composed of a yellow color, a magenta color, a cyan color and a black color, respectively.

Each of the electrophotographic photoreceptors 401*a* to 401*d* can be rotated in a predetermined direction (in a counterclockwise direction on the drawing paper) and along the rotation direction, charging rolls 402*a* to 402*d*, developing devices 404*a* to 404*d*, primary transfer rolls 410*a* to 410*d*, and cleaning blades 415*a* to 415*d* are disposed. Four color toners of black, yellow, magenta and cyan contained in toner cartridges 405*a* to 405*d* can be supplied to the developing devices 404*a* to 404*d*, respectively, and the primary transfer rolls 410*a* to 410*d* are abutted against the electrophotographic photoreceptors 401*a* to 401*d*, respectively, through the intermediate transfer belt 409.

Furthermore, an exposure device 403 is disposed at a predetermined position inside of the housing 400, and a light beam emitted from the exposure device 403 can be irradiated on the surfaces of the electrophotographic photoreceptors 401*a* to 401*d* which are electrically charged. Thanks to this construction, in the course of the electrophotographic photoreceptors 401*a* to 401*d* being rotated, respective steps of electrical charging, exposure, development, primary transfer and cleaning are sequentially performed, and toner images of respective colors are transferred one on another on the intermediate transfer belt 409.

The charging rolls 402*a* to 402*d* uniformly apply a voltage to photoreceptors by contacting an electrically conductive member (charging roll) with surfaces of the electrophotographic photoreceptors 401*a* to 401*d*, whereby the photoreceptor surface is charged to a predetermined potential (charging step). Other than the charging roll described in this exemplary embodiment, the electrical charging may be performed by a contact charging system using a charging blush, a charging film, a charging tube or the like. Furthermore, the electrical charging may also be performed by a non-contact charging system using a corotron or a scorotron.

As for the exposure device 403, an optical-system device or the like having a light source capable of exposing light on the surfaces of the electrophotographic photoreceptors 401*a* to 401*d* in a desired image pattern, such as semiconductor laser, LED (light-emitting diode) and liquid crystal shutter, may be used. Above all, when an exposure device capable of exposing non-interference light is used, an interference fringe can be prevented from occurring between the electrically conductive substrate and the photosensitive layer of each of the electrophotographic photoreceptors 401*a* to 401*d*.

In the developing devices 404*a* to 404*d*, the development can be performed using a normal developing device that performs development by contacting or not contacting the two-component electrostatic image developer (developing step). This developing device is not particularly limited as long as a it uses a two-component developer for electrostatic image development, and a known developing device may be appropriately selected according to the purpose. In the primary transfer step, a primary transfer bias having polarity opposite the toner held on an image holding member is applied to the primary transfer rolls 410*a* to 410*d*, whereby toner images of respective colors are primarily transferred in sequence from the image holding members to the intermediate transfer belt 409.

The cleaning blades 415*a* to 415*d* are used to remove the residual toner adhering to surfaces of the electrophotographic photoreceptors after the transfer step, and the electrophotographic photoreceptors cleaned by the cleaning blades are repeatedly used in the image forming process above. Examples of the material for the cleaning blade include urethane rubber, neoprene rubber and silicone rubber.

The intermediate transfer belt 409 is supported at a predetermined tension by a drive roll 406, a backup roll 408 and a tension roll 407 and can be rotated by the rotation of these rolls without generating flexure. Also, a secondary transfer roll 413 is disposed to abut against the backup roll 408 through the intermediate transfer belt 409.

A secondary transfer bias voltage having polarity opposite the toner on the intermediate transfer belt is applied to the secondary transfer roll 413, whereby the toner is secondarily transferred from the intermediate transfer belt to a recording medium. The intermediate transfer belt 409 passed between the backup roll 408 and the secondary transfer roll 413 is surface-cleaned, for example, by a cleaning blade 416 disposed in the vicinity of the drive roll 406 or by a destaticizer (not shown) and then repeatedly used for the next image forming process. Also, a tray (transfer-receiving medium tray) 411 is provided at a predetermined position inside of the housing 400, and a transfer-receiving medium 500 such as paper in the tray 411 is conveyed by conveying rolls 412 sequentially between the intermediate transfer belt 409 and the secondary transfer roll 413 and then between two fixing rolls 414 abutted against each other, and thereafter discharged outside of the housing 400.

The image forming apparatus in this exemplary embodiment is characterized by the fixing device, and assuming that the temperature when the fixing rolls 414 are heated by turning on a power source and then the heating is stopped is T, the maximum temperature exceeding T is preferably T+20° C. or less, more preferably T+10° C. or less. When the maximum temperature is in this range, it is easy to suppress gloss unevenness at the fixing. Specific examples of the method for this control include a method where the power applied to, for example, a halogen lamp that is a power source of the fixing roll 414 as a fixing member is stepwise decreased when the temperature comes close to the control temperature.

[Image Forming Method]

The image forming method in an exemplary embodiment of the present invention has at least a step of electrically charging an image holding member, a step of forming a latent image on the image holding member, a step of developing the latent image on the latent image holding member by using the above-described electrophotographic developer, a primary transfer step of transferring the developed toner image onto an intermediate transfer material, a secondary transfer step of transferring the toner image transferred on the image transfer material, onto a recording medium, and a step of fixing the toner image by means of heat and pressure. The developer is a developer containing at least the electrostatic imaging toner of the present invention. The developer may be either a one-component embodiment or a two-component embodiment.

For all of the steps above, a step known in the image forming method can be utilized.

Examples of the latent image holding member which can be used include an electrophotographic photoreceptor and a dielectric recording material. In the case of an electrophotographic photoreceptor, the electrophotographic photoreceptor surface that is evenly charged by a corotron charger, a contact charger or the like is exposed to form an electrostatic latent image (latent image forming step), and then brought into contact with or proximity to a developing rail having formed on the surface thereof a developer layer, thereby adhering toner particles to the electrostatic latent image to form a toner image on the electrophotographic photoreceptor (developing step). The toner image formed is transferred onto a transfer of a transfer-receiving material such as paper by utilizing a corotron charger or the like (transfer step). Furthermore, if desired, the toner image transferred to the transfer-receiving material surface is subjected to heat fixing by a fixing machine, whereby a final toner image is formed.

Incidentally, at the heat fixing by a fixing machine, a release agent is supplied to a fixing member of a normal fixing machine so as to prevent offset and the like, but the fixing machine of the image forming apparatus in this exemplary embodiment need not be supplied with a release agent and performs oil-less fixing.

The method of supplying a release agent to the surface of a roller or belt that is a fixing member used for heat fixing is not particularly limited, but examples thereof include a pad method using a pad impregnated with a liquid release agent, a web method, a roller method, and a non-contact shower method (spray method). Among these, the web method and the roller method are preferred. These methods are advantageous in that the release agent can be uniformly supplied and moreover, the amount supplied can be easily controlled. Incidentally, for uniformly supplying the release agent to the entire fixing member by the shower method, a blade or the like needs to be separately used.

Examples of the transfer-receiving material onto which the toner image is transferred (recording material) include plain paper used in an electrophotographic copying machine, a printer or the like, and OHP sheet.

[Addenda]

(1) The magenta electrostatic developing toner where the magenta coloring agent is a β-naphthol-type pigment such as C.I. Pigment Red 146 and C.I. Pigment Red 2, 5, 7, 8, 9, 10, 11, 12, 13, 14, 15, 16, 17, 18, 21, 22, 23, 31, 32, 95, 112, 114, 119, 136, 147, 148, 150, 164, 170, 184, 187, 188, 210, 212, 213, 222, 223, 238, 245, 253, 256, 258, 261, 266, 267, 268 and 269; and a production method thereof.

(2) The magenta electrostatic developing toner where the magenta coloring agent is C.I. Pigment Red 238; and a production method thereof.

(3) The magenta electrostatic developing toner where the inorganic particle having a median diameter of 5 nm to 70 nm is silica; and a production method thereof.

EXAMPLES

The present invention is described in greater detail below by referring to Examples, but the present invention is not limited thereto.

In Examples, the measurements are performed as follows.

—Measuring Method of Particle Size and Particle Size Distribution—

The measurement of particle diameter (sometimes referred to as a "particle size") and particle diameter distribution (sometimes referred to as a "particle size distribution") is described below.

In the case where the particle diameter measured is 2 μm or more, Coulter Multisizer Model II (manufactured by Beckman-Coulter, Corp.) is used as the measuring apparatus, and ISOTON-II (produced by Beckman-Coulter, Corp.) is used as the electrolytic solution.

As for the measuring method, from 0.5 mg to 50 mg of the measurement sample is added to a surfactant, preferably 2 ml of an aqueous 5% sodium alkylbenzenesulfonate solution, that is a dispersant, and the resulting solution is added to 100 ml of the electrolytic solution above.

The electrolytic solution having suspended therein the sample is measured by Coulter Multisizer Model. II for the particle size distribution of particles of 2 μm to 60 μm by using an aperture having an aperture diameter of 100 μm to determine the volume average distribution and number average distribution. The number of particles measured is 50,000.

The particle size distribution of the toner is determined by the following method. The measured particle size distribution is divided into particle size ranges (channels), and a volume cumulative distribution curve is drawn from the small particle size side. The cumulative volume particle diameter at cumulative 16% is defined as D16v, the cumulative volume particle diameter at cumulative 50% is defined as D50v, and the cumulative volume particle diameter at cumulative 84% is defined as D84v.

The volume average particle diameter referred to in the present invention is D50v, and the volume average particle size index GSDv is calculated by the following formula:

Formula: $GSDv=\{(D84v)/(D16v)\}^{0.5}$

In the case where the particle diameter measured is less than 2 μm, a laser diffraction particle size distribution counter (LA-700, Horiba Ltd.) is used for the measurement. As for the measuring method, a sample in the liquid dispersion state is adjusted to a solid content of about 2 g, and ion exchange water is added to adjust the volume to about 40 ml. The solution is charged into a cell to a proper concentration, and after about 2 minutes, the particle size is measured when the concentration in the cell is almost stabilized. The volume average particle diameters obtained for every channel are accumulated from the side of the volume average particle diameter being small, and the particle diameter at cumulative 50% is taken as the volume average particle diameter.

Incidentally, in the case of measuring a powder particle of an internal additive, an external additive and the like, 2 g of the measurement sample is added to a surfactant, preferably 50 ml of an aqueous 5% sodium alkylbenzenesulfonate solution, the solution is dispersed by an ultrasonic disperser (1,000 Hz) for 2 minutes, and the sample produced is measured by the same method as that for the above-described liquid dispersion.

—Measuring Method of Shape Factor SF1 of Toner—

The shape factor SF1 of the toner is a shape factor SF indicative of the unevenness degree of the toner particle surface and is calculated by the following formula:

Formula: $SF1=(ML^2/A)\times(\Pi/4)\times100$ wherein ML indicates the maximum length of the toner particle, and A indicates the projected area of the toner particle. In the measurement of the shape factor SF1 , an optical micrograph of toner particles spread on a slide glass surface is incorporated into an image analyzer through a video camera, SF is calculated on 50 toner particles, and an average value is determined.

—Measuring Method of Glass Transition Temperature—

The glass transition temperature of the toner is determined by the DSC (differential scanning calorimeter) measuring method and obtained from the main maximum peak measured in accordance with ASTMD3418-8.

For the measurement of the main maximum peak, DSC-7 manufactured by PerkinElmer, Inc. may be used. The melting temperatures of indium and zinc are used to calibrate the temperature of the detector of the measuring apparatus above, and the melting heat of indium is used to calibrate the heat quantity. An aluminum-made pan is used as the sample, an empty pan is set for the control, and the measurement is performed at the temperature rise rate of 10° C./min.

—Measuring Method of Molecular Weight and Molecular Weight Distribution of Toner and Resin Particle—

The measurement of the molecular weight distribution is performed under the following conditions. The CPC is "HLC-8120GPC, SC-8020 (manufactured by Tosoh Corporation)", two columns "TSK gel, Super HM-H (manufactured by Tosoh Corporation, 6.0 mm ID×15 cm)" are used, and THF (tetrahydrofuran) is used as the eluate. The experimental conditions are a sample concentration of 0.5%, a flow rate of 0.6 ml/min, an injected sample amount of 10 μl and a measurement temperature of 40° C., and the experiment is performed using an IR detector. Also, the calibration curve is made from 10 samples of "polystylene standard sample: TSK standard" produced by Tosoh Corporation: "A-500", "F-1", "F-10", "F-80", "F-380", "A-2500", "F-4", "F-40", "F-128" and "F-700".

—Number of Colorless Binder Resin Particles not Containing Coloring Agent and Release Agent and Having Size Analogous to that of Toner—

The observed image is photographed by LUZEX manufactured by Nireco Corporation, and the number of particles is determined by the image analysis on about 5,000 toner particles that are arbitrarily extracted. More specifically, the number of all particles in the image is measured, colorless particles therein are selected, and the shape factor SF1 of the toner and the number of colorless particles are measured. This operation is repeated until the number of toner particle becomes 5,000.

The present invention is described in greater detail below by referring to Examples and Comparative Examples, but the present invention is not limited to these Examples. In the following, unless otherwise indicated, the "parts" always means "parts by mass".

Production Example of Toner and Evaluation of Developer

Example 1

—Production of Resin Particle Liquid Dispersion (1)—

370 Parts by mass of ion-exchanged water and 0.3 parts by mass of surfactant are charged into a polymerization reaction tank and while mixing these with stirring, the temperature is raised to 75° C. Separately, the following components are charged into an emulsification tank and mixed with stirring to produce an emulsion.

| | |
|---|---|
| Ion-exchanged water | 170 parts by mass |
| Nonionic surfactant (NONIPOL 400 produced by Sanyo Chemical Industries, Ltd.) | 2 parts by mass |
| Anionic surfactant (Neogen SC, produced by Daiichi Kogyo Seiyaku Co., Ltd.) | 3 parts by mass |
| Styrene | 300 parts by mass |
| n-Butyl acrylate | 90 parts by mass |

-continued

| | |
|---|---|
| β-Carboxylethyl acrylate (hereinafter sometimes referred to as "β-CEA" | 11 parts by mass |
| Dodecanethiol | 6 parts by mass |
| 1,10-Decanediol diacrylate | 1.5 parts by mass |

When the temperature in the polymerization tank is stabilized, the produced emulsion in a 2% portion of its weight is added to the reaction tank over 10 minutes. Thereafter, 5 parts by mass of ammonium persulfate is 5-fold diluted with ion-exchanged water and added to the reaction tank over 10 minutes, and the system is held for 20 minutes. Subsequently, the remaining emulsion is added to the reaction tank over 3 hours. After the end of addition, the system is further held for 3 hours to complete the reaction.

The obtained resin particle-containing solution is centrifuged using a centrifugal separator by giving a centrifugal effect of 900 G for 10 minutes. Thereafter, the supernatant side in 50 vol % based on the total volume is collected, and the collected supernatant solution containing binder resin particles having a particle diameter of 1 μm or less is designated as Resin Particle Liquid Dispersion (1). The weight average molecular weight of the obtained resin is 36,200, and the volume average particle diameter is 212 nm.

—Production of Resin Particle Liquid Dispersion (2)—

Resin Particle Liquid Dispersion (2) is produced by not performing the centrifugal separation in the operation of Example 1. The weight average molecular weight of the obtained resin is 36,200, and the volume average particle diameter is 219 nm.

—Production of Release Agent Liquid Dispersion (1)—

| | |
|---|---|
| POLYWAX 655 (produced by Baker Petrolite Corp.) | 30 parts by mass |
| Cationic surfactant (SANISOL B50, produced by Kao Corporation) | 2 parts by mass |
| Ion-exchanged water | 68 parts by mass |

These components are heated at 120° C., treated in a high-pressure homogenizer at 50 MPa and then swiftly cooled to obtain Release Agent Liquid Dispersion (1). The volume average particle diameter of the dispersed wax is 250 nm. Incidentally, POLYWAX 655 (produced by Baker Petrolite Corp.) is a polyethylene wax and has a number average molecular weight of 655 and a melting temperature of 99° C.

(Production of Coloring Agent-Inorganic Particle Aggregate Liquid Dispersion)

—Preparation of Magenta Coloring Agent-Inorganic Particle Aggregate Liquid Dispersion (1)—

| | |
|---|---|
| C.I. Pigment Red 238 (produced by Sanyo Color Works, Ltd.) | 50 parts by mass |
| Ionic surfactant, Neogen RK (produced by Daiichi Kogyo Seiyaku Co., Ltd.) | 5 parts by mass |
| Ion-exchanged water | 192.9 parts by mass |

These components are mixed and treated by Ultimizer (manufactured by Sugino Machine Limited) at 240 MPa for 10 minutes to obtain a magenta coloring agent liquid dispersion having a number average particle diameter of 137 nm.

| | |
|---|---|
| Silica (Snowtex XS, produced by Nissan Chemicals Industries, Ltd., median diameter: 5 nm) | 2.0 parts by mass |
| Polyaluminum chloride as aggregating agent | 1 part by mass |

The aggregating agent is added to a mixture obtained by mixing the coloring agent liquid dispersion and silica at a stirring speed of 300 rpm, and the mixture is stirred by decreasing the stirring speed to 450 rpm for 10 minutes and then stirred by further decreasing the stirring speed to 300 rpm to obtain Magenta Coloring Agent-Inorganic Particle Aggregate Liquid Dispersion (1).

The following components are charged into the reaction tank and thoroughly stirred and mixed.

| | |
|---|---|
| Ion-exchanged water | 300 parts by mass |
| Resin Particle Liquid Dispersion (1) | 135 parts by mass |
| Magenta Coloring Agent-Inorganic Particle Aggregate Liquid Dispersion (1) | 28.1 parts by mass |
| Release Agent Liquid Dispersion (1) | 24 parts by mass |

Thereafter, 14.5 parts by mass of an aqueous 1% polyaluminum chloride solution as an aggregating agent is gradually added while applying a shearing force in Ultraturrax. Since the viscosity of slurry is increased as the aggregating agent is added, the rotation speed of Ultraturrax is raised to a maximum of 7,000 rpm and after the end of addition, the dispersion treatment is further performed for 5 minutes.

The temperature of this slurry is gradually raised with thorough stirring and held at 48° C. for 2 hours, as a result, the average particle diameter of aggregated particles becomes 5.4 μm. At this time, 70 parts by mass of Resin Particle Liquid Dispersion (1) is anew gently added over 10 minutes and held for 1 hour, as a result, the average particle diameter of aggregated particles becomes 5.0 μm. Subsequently, the pH of the reaction tank is adjusted to 7.0, the temperature is gently raised to 95° C., and the system is held for 4 hours to effect coalescence of aggregated particles and then cooled to 40° C. to obtain Magenta Toner 1 having an average particle diameter of 5.8 μm. In Magenta Toner 1, the number of inorganic binder resin particles having SF of 110 or less is 20 per 5,000 toner particles.

Example 2

Production of Coloring Agent-Inorganic Particle Aggregate Liquid Dispersion

—Preparation of Magenta Coloring Agent-Inorganic Particle Aggregate Liquid Dispersion (2)—

| | |
|---|---|
| C.I. Pigment Red 238 (produced by Sanyo Color Works, Ltd.) | 50 parts by mass |
| Silica (Snowtex XS, produced by Nissan Chemicals Industries, Ltd., median diameter: 40 nm) | 0.055 parts by mass |
| Ion-exchanged water | 195 parts by mass |

These components are mixed and dispersed by Ultimizer (manufactured by Sugino Machine Limited) at a stirring speed of 1,200 rpm for 10 minutes and after decreasing the stirring speed to 1,000 rpm,

| | |
|---|---|
| Ionic surfactant, Neogen RK (produced by Daiichi Kogyo Seiyaku Co., Ltd.) | 5 parts by mass |

is added to obtain Magenta Coloring Agent-Inorganic Particle Aggregate Liquid Dispersion (2).

Thereafter, Magenta Toner 2 is produced in accordance with Example 1 except for using Magenta Coloring Agent-Inorganic Particle Aggregate Liquid Dispersion (2) in place of Magenta Coloring Agent-Inorganic Particle Aggregate Liquid Dispersion (1). The particle diameter of the obtained toner is 5.7 μm, and the number of colorless binder resin particles having SF of 110 or less in 5,000 toner particles is 10.

Example 3

Production of Coloring Agent-Inorganic Particle Aggregate Liquid Dispersion

—Preparation of Magenta Coloring Agent-Inorganic Particle Aggregate Liquid Dispersion (3)—

| | |
|---|---|
| C.I. Pigment Red 238 (produced by Sanyo Color Works, Ltd.) | 50 parts by mass |
| Silica (Snowtex XL, produced by Nissan Chemicals Industries, Ltd., median diameter: 55 nm) | 0.28 parts by mass |
| Ion-exchanged water | 195 parts by mass |

These components are mixed and dispersed by Ultimizer (manufactured by Sugino Machine Limited) at a stirring speed of 1,200 rpm for 10 minutes and after decreasing the stirring speed to 1,000 rpm,

| | |
|---|---|
| Ionic surfactant, Neogen RK (produced by Daiichi Kogyo Seiyaku Co., Ltd.) | 5 parts by mass |

is added to obtain Magenta Coloring Agent-Inorganic Particle Aggregate Liquid Dispersion (3).

Thereafter, Magenta Toner 3 is produced in accordance with Example 1 except for using Magenta Coloring Agent-Inorganic Particle Aggregate Liquid Dispersion (3) in place of Magenta Coloring Agent-Inorganic Particle Aggregate Liquid Dispersion (1). The particle diameter of the obtained toner is 5.7 μm, and the number of colorless binder resin particles having SF of 110 or less in 5,000 toner particles is 28.

Example 4

Production of Coloring Agent-Inorganic Particle Aggregate Liquid Dispersion

—Preparation of Magenta Coloring Agent-Inorganic Particle Aggregate Liquid Dispersion (4)—

Magenta Coloring Agent-Inorganic Particle Aggregate Liquid Dispersion (4) is prepared in the same manner as in the preparation of Magenta Coloring Agent-Inorganic Particle Aggregate Liquid Dispersion (2) except for changing the coloring agent to 50 parts by mass of C.I. Pigment Red 53:1 (A120 Red, produced by Dainichiseika Color & Chemicals Mfg. Co., Ltd.).

Thereafter, Magenta Toner 4 is produced in accordance with Example 2 except for using Magenta Coloring Agent-Inorganic Particle Aggregate Liquid Dispersion (4) in place of Magenta Coloring Agent-Inorganic Particle Aggregate Liquid Dispersion (1). The particle diameter of the obtained toner is 5.6 μm, and the number of colorless binder resin particles having SF of 110 or less in 5,000 toner particles is 42.

Example 5

Production of Coloring Agent-Inorganic Particle Aggregate Liquid Dispersion

—Preparation of Magenta Coloring Agent-Inorganic Particle Aggregate Liquid Dispersion (5)—

Magenta Coloring Agent-Inorganic Particle Aggregate Liquid Dispersion (5) is prepared in the same manner as in the preparation of Magenta Coloring Agent-Inorganic Particle Aggregate Liquid Dispersion (2) except for changing the coloring agent to 50 parts by mass of C.I. Pigment Red 5 (SEIKAFAST CARMINE 3840 (azo pigment), produced by Dainichiseika Color & Chemicals Mfg. Co., Ltd.).

Thereafter, Magenta Toner 5 is produced in accordance with Example 2 except for using Magenta Coloring Agent-Inorganic Particle Aggregate Liquid Dispersion (5) in place of Magenta Coloring Agent-Inorganic Particle Aggregate Liquid Dispersion (1). The particle diameter of the obtained toner is 5.6 μm, and the number of colorless binder resin particles having SF of 110 or less in 5,000 toner particles is 42.

Example 6

Production of Coloring Agent-Inorganic Particle Aggregate Liquid Dispersion

—Preparation of Magenta Coloring Agent-Inorganic Particle Aggregate Liquid Dispersion (6)—

Magenta Coloring Agent-Inorganic Particle Aggregate Liquid Dispersion (6) is prepared in the same manner as in the preparation of Magenta Coloring Agent-Inorganic Particle Aggregate Liquid Dispersion (2) except for changing the coloring agent to 50 parts by mass of C.I. Pigment Red 170 (SEIKAFAST Red 3820, produced by Dainichiseika Color & Chemicals Mfg. Co., Ltd.).

Thereafter, Magenta Toner 6 is produced in accordance with Example 2 except for using Magenta Coloring Agent-Inorganic Particle Aggregate Liquid Dispersion (6) in place of Magenta Coloring Agent-Inorganic Particle Aggregate Liquid Dispersion (1). The particle diameter of the obtained toner is 5.7 μm, and the number of colorless binder resin particles having SF of 110 or less in 5,000 toner particles is 40.

Example 7

Production of Coloring Agent-Inorganic Particle Aggregate Liquid Dispersion

—Preparation of Magenta Coloring Agent-Inorganic Particle Aggregate Liquid Dispersion (7)—

| | |
|---|---|
| Titania (produced by Tayca Corporation, median diameter: 10 nm) | 0.4 parts by mass |
| Ion-exchanged water | 195 parts by mass |

These components are mixed and dispersed by Ultimizer (manufactured by Sugino Machine Limited) at a stirring speed of 1,200 rpm for 10 minutes and after decreasing the stirring speed to 1,000 rpm,

| | |
|---|---|
| Ionic surfactant, Neogen RK (produced by Daiichi Kogyo Seiyaku Co., Ltd.) | 5 parts by mass |

is added to obtain Magenta Coloring Agent-Inorganic Particle Aggregate Liquid Dispersion (7).

Thereafter, Magenta Toner 7 is produced in accordance with Example 1 except for using Magenta Coloring Agent-Inorganic Particle Aggregate Liquid Dispersion (7) in place of Magenta Coloring Agent-Inorganic Particle Aggregate Liquid Dispersion (1). The particle diameter of the obtained toner is 5.7 μm, and the number of colorless binder resin particles having SF of 110 or less in 5,000 toner particles is 39.

Comparative Example 1

Preparation of Magenta Coloring Agent Liquid Dispersion (8)

| | |
|---|---|
| C.I. Pigment Red 238 (produced by Sanyo Color Works, Ltd.) | 50 parts by mass |
| Ionic surfactant, Neogen RK (produced by Daiichi Kogyo Seiyaku Co., Ltd.) | 5 parts by mass |
| Ion-exchanged water | 195 parts by mass |

These components are mixed and dispersed by Ultimizer (manufactured by Sugino Machine Limited) for 10 minutes to obtain Magenta Coloring Agent Liquid Dispersion (8) having a number average particle diameter of 168 nm.

Thereafter, Magenta Toner 8 is produced in accordance with Example 1 except for using Magenta Coloring Agent Liquid Dispersion (8) in place of Magenta Coloring Agent-Inorganic Particle Aggregate Liquid Dispersion (1). The particle diameter of the obtained toner is 5.8 μm, and the number of colorless binder resin particles having SF of 110 or less in 5,000 toner particles is 83.

Comparative Example 2

Production of Coloring Agent-Inorganic Particle Aggregate Liquid Dispersion

—Preparation of Magenta Coloring Agent-Inorganic Particle Aggregate Liquid Dispersion (9)—

Magenta Coloring Agent-Inorganic Particle Aggregate Liquid Dispersion (9) is prepared in the same manner as in the preparation of Magenta Coloring Agent-Inorganic Particle Aggregate Liquid Dispersion (2) except for changing the amount of silica to 0.041 parts by mass.

Thereafter, Magenta Toner 9 is produced in accordance with Example 2 except for using Magenta Coloring Agent-Inorganic Particle Aggregate Liquid Dispersion (9) in place of Magenta Coloring Agent-Inorganic Particle Aggregate Liquid Dispersion (1). The particle diameter of the obtained toner is 5.5 μm, and the number of colorless binder resin particles having SF of 110 or less in 5,000 toner particles is 68.

Comparative Example 3

Production of Coloring Agent-Inorganic Particle Aggregate Liquid Dispersion

—Preparation of Magenta Coloring Agent-Inorganic Particle Aggregate Liquid Dispersion (10)—

Magenta Coloring Agent-Inorganic Particle Aggregate Liquid Dispersion (10) is prepared in the same manner as in the preparation of Magenta Coloring Agent-Inorganic Particle Aggregate Liquid Dispersion (2) except for changing the amount of silica to 2.2 parts by mass.

Thereafter, Magenta Toner 10 is produced in accordance with Example 2 except for using Magenta Coloring Agent-Inorganic Particle Aggregate Liquid Dispersion (10) in place of Magenta Coloring Agent-Inorganic Particle Aggregate Liquid Dispersion (1). The particle diameter of the obtained toner is 5.8 μm, and the number of colorless binder resin particles having SF of 110 or less in 5,000 toner particles is 55.

Comparative Example 4

Production of Coloring Agent-Inorganic Particle Aggregate Liquid Dispersion

—Preparation of Magenta Coloring Agent-Inorganic Particle Aggregate Liquid Dispersion (11)—

Magenta Coloring Agent-Inorganic Particle Aggregate Liquid Dispersion (11) is prepared in the same manner as in the preparation of Magenta Coloring Agent-Inorganic Particle Aggregate Liquid Dispersion (2) except for changing silica to Snowtex ZL (produced by Nissan Chemicals Industries, Ltd., median diameter: 85 nm)

Thereafter, Magenta Toner 11 is produced in accordance with Example 1 except for using Magenta Coloring Agent-Inorganic Particle Aggregate Liquid Dispersion (11) in place of Magenta Coloring Agent-Inorganic Particle Aggregate Liquid Dispersion (1). The particle diameter of the obtained toner is 5.9 μm, and the number of colorless binder resin particles having SF of 110 or less in 5,000 toner particles is 61.

Comparative Example 5

Magenta Toner 12 is produced in the same manner as Toner 2 except for using Resin Particle Liquid Dispersion (2) in place of Resin Particle Liquid Dispersion (1). The particle diameter of the obtained toner is 6.2 μm, and the number of colorless binder resin particles having SF of 110 or less in 5,000 toner particles is 85.

[Evaluation Method of Color Reproduction]

An image output is performed in a modified machine (modified not to have a trickle mechanism) of DocuCentre Color 400 manufactured by Fuji Xerox Co., Ltd., shown in FIG. 3, where Developer 1 for Electrostatic Development to Developer 12 for Electrostatic Development are filled in developing devices and Magenta Toners 1 to 12 are filled in cartridges. Thereafter, an image from an original (test chart No. 5-1, 1995 of the Imaging Society of Japan) is continuously output on 1,000 sheets under a high-temperature high-humidity (28° C., 85% RH) environment, and by evaluating the image on the 1,001th sheet for Lab of the image at +1.8 in the yellow portion of the test chart No. 5-1, 1995 of the Imaging Society of Japan, the difference is rated. The results are shown in Table 1. Here, dL, da and db indicate respective differences of Lab on the 1,001th sheet based on the first sheet, and a difference of less than 1.0 is acceptable. The measurement of colors is performed by the method described in JIS Z 8729-2004.

TABLE 1

| | Developer | Binder Resin Particle Liquid Dispersion | Colorless Binder Resin Particle of SF < 110 Number of Particles | Monoazo-Type Pigment Kind | Inorganic Particle Kind | Median Diameter (nm) | Content Based on Toner (mass %) | Color Reproduction dL | da | db |
|---|---|---|---|---|---|---|---|---|---|---|
| Example 1 | Developer 1 | Production (1) | 20 | C.I. Pigment Red 238 | silica | 5 | 0.39 | 0.6 | 0.8 | 0.7 |
| Example 2 | Developer 2 | Production (1) | 10 | C.I. Pigment Red 238 | silica | 40 | 0.011 | 0.3 | 0.4 | 0.3 |
| Example 3 | Developer 3 | Production (1) | 28 | C.I. Pigment Red 238 | silica | 55 | 0.11 | 0.8 | 0.7 | 0.9 |
| Example 4 | Developer 4 | Production (1) | 42 | C.I. Pigment Red 53:1 | silica | 40 | 0.011 | 0.8 | 0.6 | 0.5 |
| Example 5 | Developer 5 | Production (1) | 46 | C.I. Pigment Red 5 | silica | 40 | 0.011 | 0.4 | 0.6 | 0.7 |
| Example 6 | Developer 6 | Production (1) | 40 | C.I. Pigment Red 170 | silica | 40 | 0.011 | 0.5 | 0.7 | 0.9 |
| Example 7 | Developer 7 | Production (1) | 39 | C.I. Pigment Red 238 | titania | 10 | 0.078 | 0.7 | 0.7 | 0.6 |
| Comparative Example 1 | Developer 8 | Production (1) | 83 | C.I. Pigment Red 238 | — | — | — | 1.7 | 1.6 | 1.9 |
| Comparative Example 2 | Developer 9 | Production (1) | 68 | C.I. Pigment Red 238 | silica | 40 | 0.008 | 1.4 | 1.3 | 1.7 |
| Comparative Example 3 | Developer 10 | Production (1) | 55 | C.I. Pigment Red 238 | silica | 40 | 0.5 | 1.2 | 1.4 | 1.6 |
| Comparative Example 4 | Developer 11 | Production (1) | 61 | C.I. Pigment Red 238 | silica | 85 | 0.01 | 1.5 | 1.5 | 1.6 |
| Comparative Example 5 | Developer 12 | Production (2) | 85 | C.I. Pigment Red 238 | silica | 40 | 0.011 | 1.6 | 1.4 | 1.9 |

Note:
The "colorless binder resin particle" indicates a binder resin particle not containing a coloring agent and a release agent, contained in the toner The results in Table 1 reveal the followings. Within the range specified in the present invention, the color reproduction is acceptable, whereas as seen from Comparative Examples 1 to 5, when the number of resin particles in 5,000 toner particles exceeds 50, the color reproduction of image deteriorates.

The present invention can be applied, for example, to a cartridge of an image forming apparatus using an electrophotographic system, such as copier and printer.

What is claimed is:

1. A magenta electrostatic developing toner comprising:

binder resin particles that do not contain a coloring agent or a release agent and have a shape factor SF1 of about 110 or less, the number of the binder resin particles being about 50 or less per 5,000 electrostatic developing toner particles; and inorganic particles that have a median diameter of about 5 nm to about 70 nm in an amount of about 0.01 mass % to about 0.4 mass % based on the mass of the electrostatic developing toner; and a magenta coloring agent that has an azo group.

2. The magenta electrostatic developing toner as claimed in claim 1, wherein the inorganic particles are silica.

3. The magenta electrostatic developing toner as claimed in claim 1, wherein the magenta coloring agent having an azo group is a monoazo-based pigment.

4. The magenta electrostatic developing toner as claimed in claim 1, wherein the monoazo-based pigment is C.I. Pigment Red 238.

5. The magenta electrostatic developing toner as claimed in claim 1, further comprising:

a release agent.

6. The magenta electrostatic developing toner as claimed in claim 5, wherein the release agent has a weight average molecular weight of about 500 to about 5,000.

7. The magenta electrostatic developing toner as claimed in claim 5, wherein the release agent has a melting temperature of about 60° C. to about 100° C.

8. The magenta electrostatic developing toner as claimed in claim 1, which has a volume average particle diameter of about 3 μm to about 10 μm.

9. A developer for electrostatic development, comprising:

the magenta electrostatic developing toner claimed in claim 1; and a carrier.

10. An image forming method comprising:

electrostatically charging a photoreceptor;

exposing the electrostatically charged photoreceptor to form a latent image on the photoreceptor;

developing the latent image to form a developed image;

transferring the developed image onto a transfer-receiving material; and fixing a toner on a fixing substrate by heating, wherein the toner is the magenta electrostatically developing toner claimed in claim 1.

11. An image forming apparatus comprising:

a latent image forming unit that forms a latent image on a latent image holding member;

a developing unit that develops the latent image by using a developer for electrostatic development;

a transfer unit that transfers the developed toner image onto a transfer-receiving material; and a fixing unit that fixes the toner image on the transfer-receiving material by heating, wherein the developer for electrostatic development is the developer for electrostatic development claimed in claim 9.

* * * * *